US008353712B2

(12) United States Patent
Makino

(10) Patent No.: US 8,353,712 B2
(45) Date of Patent: Jan. 15, 2013

(54) LEVER-TYPE CONNECTOR

(75) Inventor: Kenji Makino, Yokkaichi (JP)

(73) Assignee: Sumitomo Wiring Systems, Ltd. (JP)

( * ) Notice: Subject to any disclaimer, the term of this patent is extended or adjusted under 35 U.S.C. 154(b) by 0 days.

(21) Appl. No.: 13/246,953

(22) Filed: Sep. 28, 2011

(65) Prior Publication Data

US 2012/0129381 A1 May 24, 2012

(30) Foreign Application Priority Data

Nov. 19, 2010 (JP) ..... 2010-258507

(51) Int. Cl.
*H01R 13/62* (2006.01)

(52) U.S. Cl. ..... 439/157; 439/372

(58) Field of Classification Search ..... 439/157, 439/160, 266, 332, 372
See application file for complete search history.

(56) References Cited

U.S. PATENT DOCUMENTS 7,670,159 B2 3/2010 Shamoto et al.
2009/0325411 A1* 12/2009 Matsumura ..... 439/157
2010/0151714 A1* 6/2010 Ambo et al. ..... 439/157
2010/0178787 A1 7/2010 Lux
2010/0210127 A1 8/2010 Matsumura et al.

FOREIGN PATENT DOCUMENTS

EP 1919038 A1 5/2008

* cited by examiner

*Primary Examiner* — Khiem Nguyen
(74) *Attorney, Agent, or Firm* — Gerald E. Hespos; Michael J. Porco; Matthew T. Hespos

(57) ABSTRACT

A housing (20) is formed with pairs of projections (31A, 31B) at opposite sides in a width direction perpendicular to a connecting direction and supporting shafts (29) located between the projections (31A, 31B) at the opposite widthwise sides and behind the projections (31A, 31B) in the connecting direction and adapted to rotatably support a lever (60). The lever (60) is formed with stoppers for preventing a rotation of the lever (60) by being engaged with the projections (31A) on one widthwise side at a connection start position. Further, the lever (60) is formed with pressing portions (72) for correcting a connection posture of the housing (20) by pressing the projections (31B) on the other widthwise side in the connecting direction when the housing (20) is inclined from a proper connection posture with respect to a mating housing (80) in a process reaching a connection position.

11 Claims, 8 Drawing Sheets

LEVER-TYPE CONNECTOR

BACKGROUND OF THE INVENTION

1. Field of the Invention

The invention relates to a lever-type connector.

2. Description of the Related Art

A lever-type connector has housings that are connected by a power multiplying action of a lever. One housing may be inclined with respect to the mating housing so as to be more connected at one widthwise side and less connected at the other widthwise side in the process of rotating the lever since a force acting direction of the lever is likely to be skewed in a width direction. U.S. Pat. No. 7,670,159 relates to a lever-type connector that attempts to address the above-identified problems. This connector has pairs of supporting shafts formed on the opposite widthwise sides of one housing. A lever is supported rotatably on the supporting shafts on a first widthwise side. The lever has recessed grooves and the back ends of recessed grooves formed in the lever contact the supporting shafts on the second widthwise side in a final stage of the rotation process. The supporting shafts on the second widthwise side are pressed forward in a connecting direction to correct an inclined posture of the housing with respect to a mating housing. The supporting shafts are formed at a rear end in the connecting direction in the above-described lever-type connector. Contact positions of the lever with the supporting shafts are at the rear and the recessed grooves are deep. As a result, strength of the lever may become insufficient.

The invention was completed in view of the above situation and an object thereof is to ensure strength of a lever in a lever-type connector capable of correcting a connection posture of a housing.

SUMMARY OF THE INVENTION

The invention relates to a lever-type connector with a housing that is connectable to a mating housing. A lever is mounted to the housing and is displaceable between a connection start position and a connection position, thereby causing the two housings to reach a properly connected state. The housing has two projections at opposite sides in a width direction, which is perpendicular to a connecting direction. A supporting shaft is located between the projections at the opposite widthwise sides and behind the projections in the connecting direction. The supporting shaft is adapted to displaceably support the lever. The lever is formed with at least one pressing portion for correcting a connection posture of the housing by pressing the projection on the other widthwise side in the connecting direction when the housing is inclined from a proper connection posture with respect to the mating housing in a process reaching the connection position.

The housing may be inclined from the proper connection posture with respect to The mating housing in the process of moving the lever toward the connection position. However, the pressing portion of the lever presses the projection on the other widthwise side of the housing to correct the connection posture of the housing. The supporting shaft is formed behind the projections in the connecting direction, and hence the projections are formed before the supporting shaft in the connecting direction. As a result, the pressing portion need not be located at a rear position in the lever. Therefore, it is not necessary to form a large cutout area in the lever and strength of the lever can be ensured.

The lever preferably is mounted to the housing for rotation between the connection start position and the connection position. Rotation of the lever from the connection start position to the connection position while being engaged with the mating housing causes the two housings to reach the properly connected state.

The lever preferably is formed with at least one stopper that engages the projection on one widthwise side at the connection start position for preventing a displacement of the lever.

A bottomed receiving groove is formed in the inner surface of the lever and makes an opening at the front end of the lever in the connecting direction. Additionally, the pressing portion preferably is formed at the back end of the receiving groove and the projection on the other widthwise side is inserted in the receiving groove at the connection position. As a result, the projection is protected from external matters.

The stopper of the lever reversed in the width direction preferably is engageable with the projection on the other widthwise side to prevent a movement of the lever at the connection start position. Thus, it is not necessary to provide a separate means for preventing a movement of the lever and the construction of the housing is simplified.

The pressing portion preferably is substantially parallel to a front end of the lever and is arranged substantially horizontally along the width direction at a connection position.

The lever preferably comprises at least one resilient locking piece and the housing comprises at least one bulge that interacts with the resilient locking piece so as to lock the lever at the connecting start position. A pressing force applied to the lever at the connection start position that urges the lever toward the connection position causes the resilient locking piece to deform resiliently and to disengage from the bulge.

The bulge preferably is arranged more outward in the width direction and more forward than the respective projection.

The respective projections and the respective bulges preferably are arranged substantially symmetrically at the opposite sides of the widthwise center.

Two supporting shafts preferably project from the housing and substantially are arranged symmetrically with respect to the widthwise center of the housing.

These and other objects, features and advantages of the invention will become more apparent upon reading the following detailed description of preferred embodiments and accompanying drawings. It should be understood that even though embodiments are separately described, single features thereof may be combined to additional embodiments.

DETAILED DESCRIPTION OF THE PREFERRED EMBODIMENTS

Figure 1:
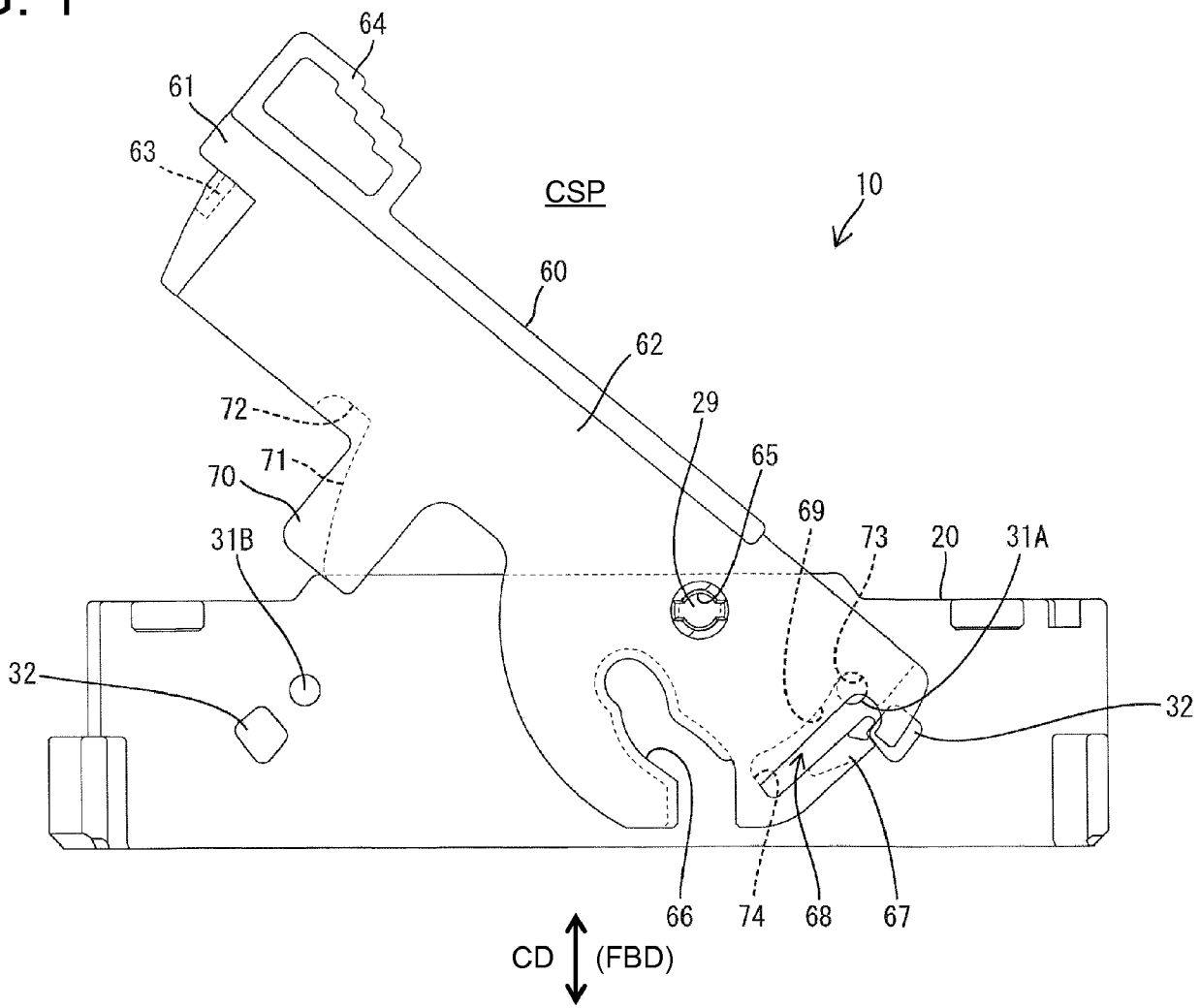
FIG. 1 is a plan view showing a state where a lever is held at a connection start position in a lever-type connector according to a first embodiment of the invention.

A lever-type connector in accordance with a first embodiment of the invention is identified generally by the numeral 10 in FIGS. 1 to 6. The lever-type connector 10 includes a housing 20 and a lever 60 rotatably or pivotably mounted on the housing 20. The housing 20 is connectable to a mating housing 80 along a connecting direction CD. In the following description, ends of the two housings 20, 80 to be connected to each other are referred to as front ends concerning forward and backward directions (FBD).

Figure 2:
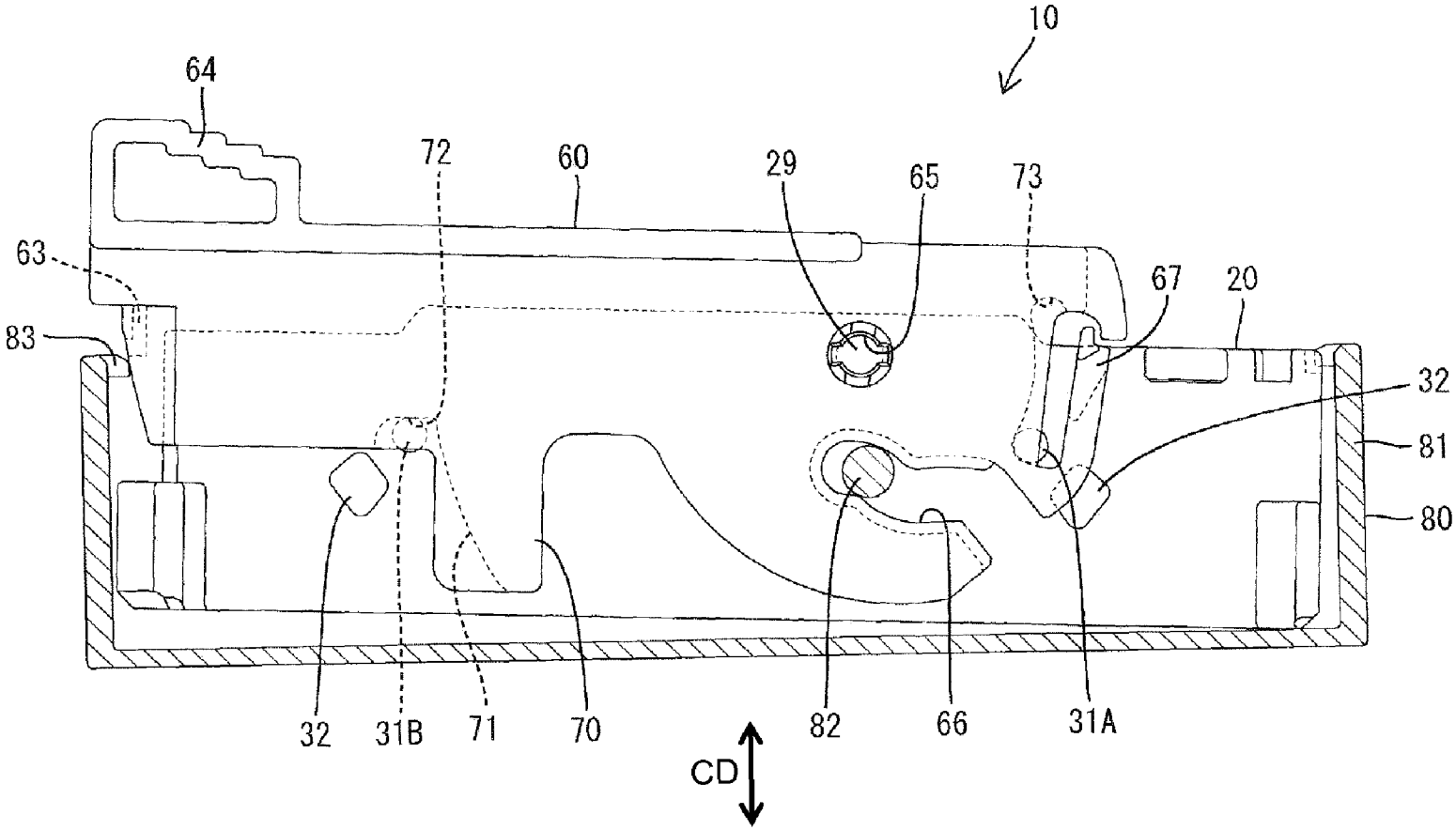
FIG. 2 is a plan view showing a state where pressing portions of the lever are pressing projections on another widthwise side when a housing is inclined from a proper connection posture with respect to a mating housing in the process of connecting the two housings.
Figure 3:
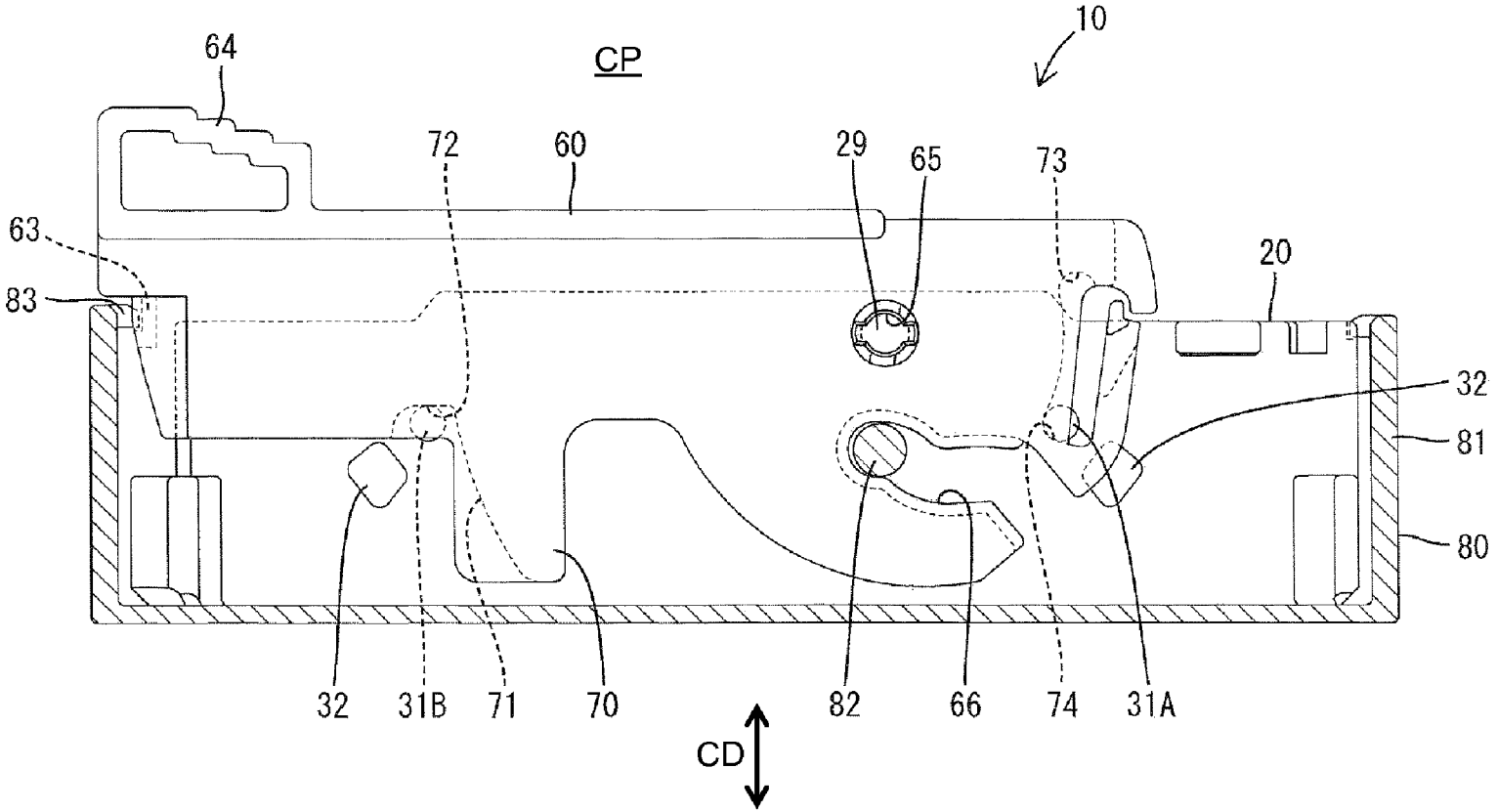
FIG. 3 is a plan view showing a state where the two housings are properly connected.

The mating housing 80 is made e.g. of synthetic resin and includes a rectangular tubular receptacle 81 that is long and narrow in a width direction, as shown in FIG. 2. Substantially cylindrical cam followers 82 project from opposite upper and lower walls of the receptacle 81. Further, a claw-shaped engaging portion 83 projects in at the opening edge of the receptacle 81.

Figure 4:
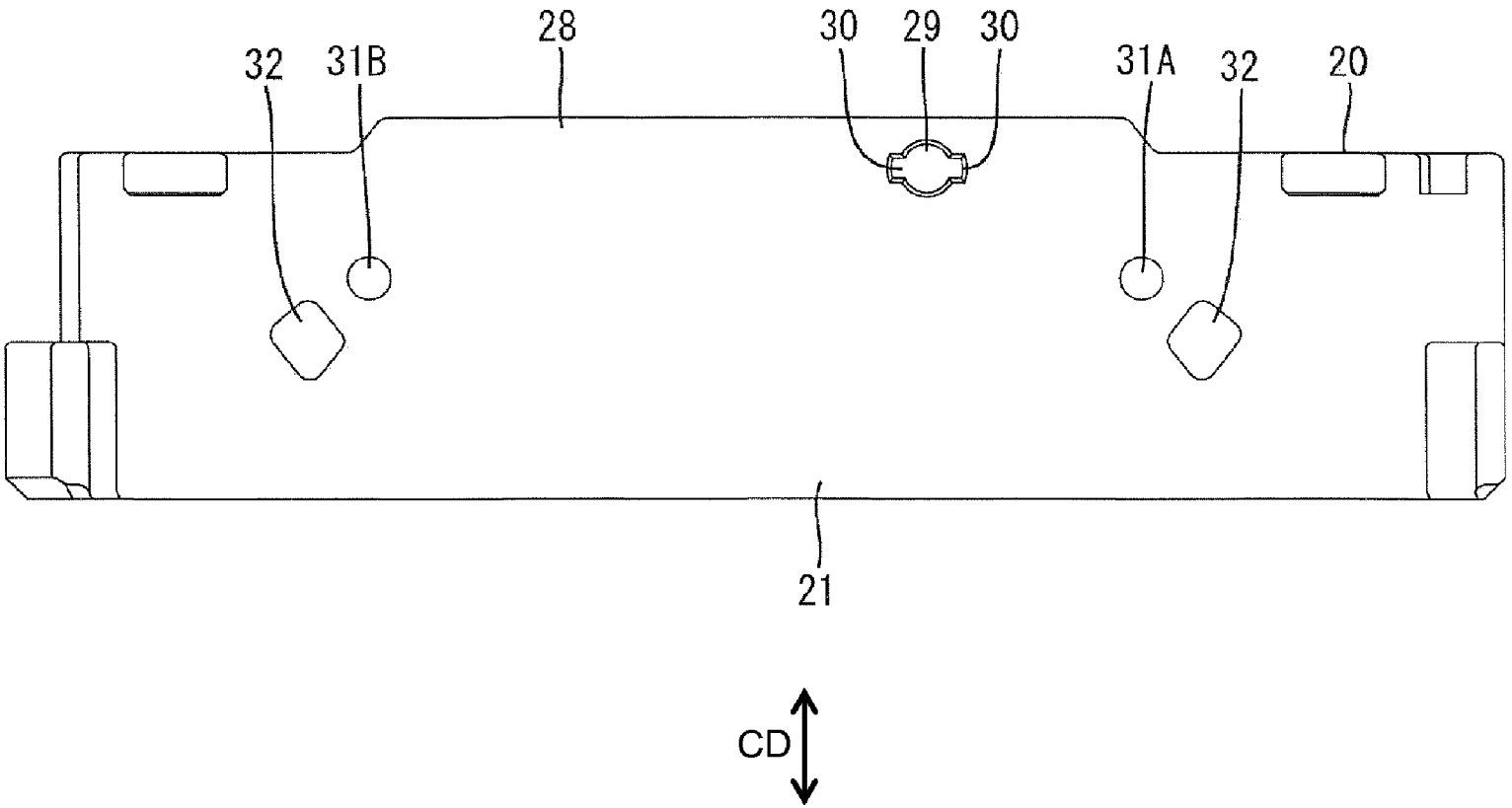
FIG. 4 is a plan view of the housing.
Figure 5:
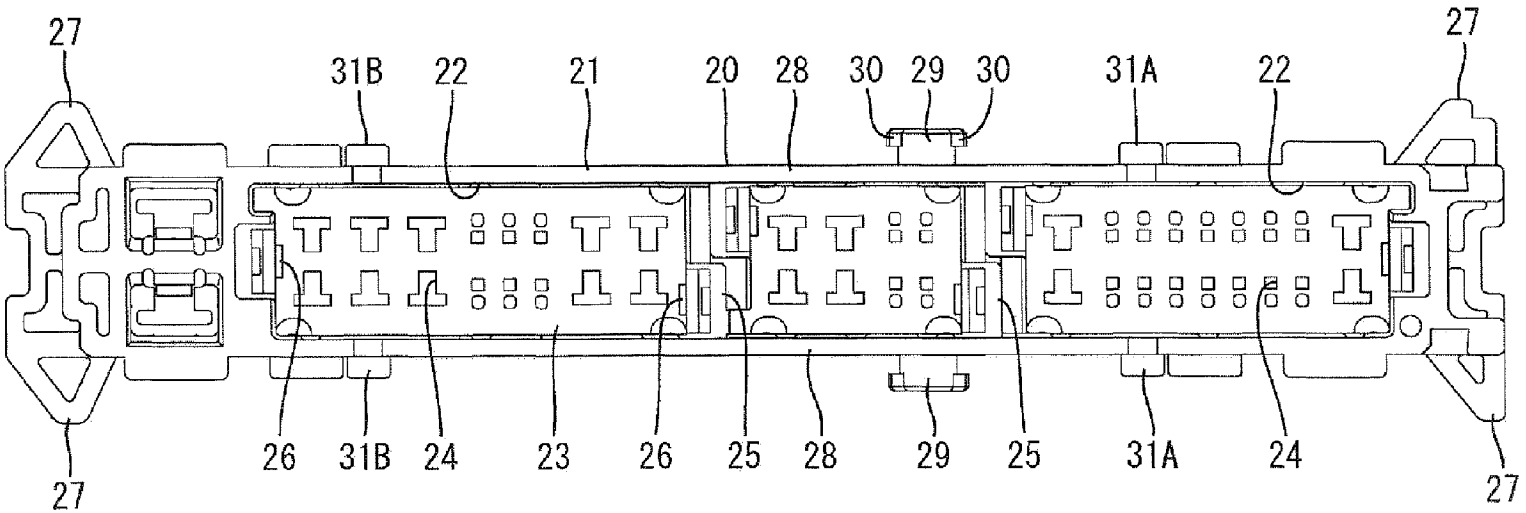
FIG. 5 is a rear view of the housing.

The housing 20 is made e.g. of synthetic resin and includes a frame 21 substantially in the form of a rectangular box that is long and narrow in the width direction, as shown in FIGS. 4 and 5. The frame 21 is formed with rearwardly open housing recesses 22 that are juxtaposed in the width direction. The front surface of the frame 21 is partly closed by a front wall 23 that is formed with tab insertion holes 24 for receiving tabs (not shown) of respective mating terminal fittings. A block-shaped sub-housing (not shown) can be housed in each housing recess 22. Partition walls 25 partition the respective housing recesses 22 and locks 26 are formed on the partition walls 25 and on the inner surfaces of the opposite side walls of the frame 21 for holding and retaining the sub-housings in the respective housing recesses 22. Terminal fittings (not shown) are inserted into the sub-housings and wires (not shown) connected to the respective terminal fittings are drawn out through the rear surface of the frame 21.

Ribs 27 project from opposite widthwise ends of the outer surface of each of the upper and lower walls of the frame 21. The respective ribs 27 are distinguished by a difference between the shapes and/or positions thereof to avoid having the housing 20 connected to the mating housing 80 in an incorrect posture. Further, two projecting parts 28 extend along intermediate or central parts of the rear end edges of the upper and lower walls of the frame 21 and project backward.

Two substantially cylindrical supporting shafts 29 project from positions on the projecting parts 28 of the frame 21 displaced toward one widthwise side from the widthwise center. Retaining pieces 30 are so formed at the upper end thereof as to project toward the opposite widthwise sides.

Two projections 31A, 31B and two bulges 32 are formed on the outer surface of each of the upper and lower walls of the frame 21 at the opposite widthwise sides of the widthwise center and before or adjacent to the supporting shaft 29. The projections 31A, 31B are substantially cylindrical and have diameters smaller than the supporting shafts 29. Further, the projections 31A, 31B are at substantially the same positions as the opposite widthwise ends of the projecting parts 28 and more outward than the supporting shafts 29 in the width direction. In other words, the supporting shafts 29 are between the projections 31A, 31B on the opposite widthwise sides with respect to the width direction.

The bulges 32 are more outward in the width direction and more forward than the respective projections 31A, 31B. The bulges 32 include parts substantially parallel to the outer surfaces of the upper and lower walls of the frame 21. Note that the projections 31A, 31B and the bulges 32 are arranged substantially symmetrically at the opposite sides of the widthwise center.

Figure 6:
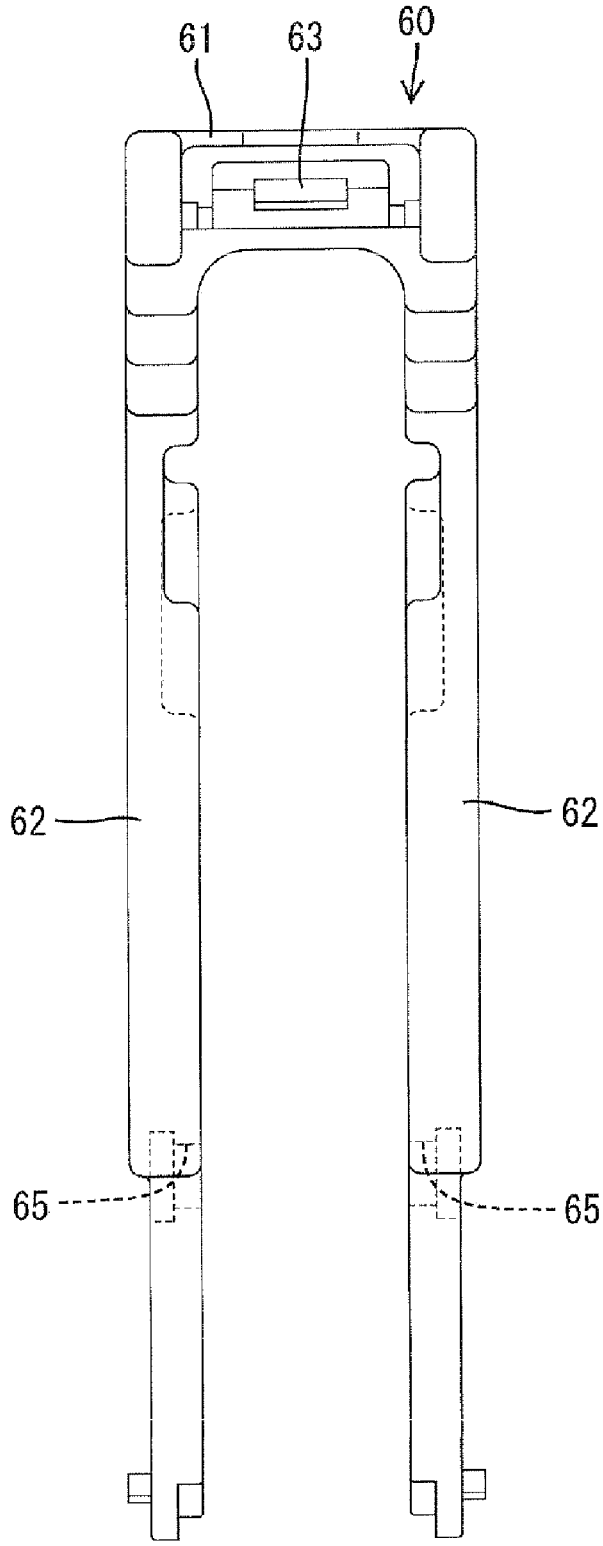
FIG. 6 is a side view of the lever.

The lever 60 is made e.g. of synthetic resin and, as shown in FIGS. 1 and 6, includes a coupling 61 and two substantially parallel arms 62 projecting from opposite front and rear ends of the coupling 61 to define a U-shape. A resiliently deformable lock 63 is formed at the coupling 61. Further, a stepped grip 64 project at or near a rear end of the coupling 61, so that the grip 64 can be gripped e.g. by fingers. Bearing holes 65 penetrate through leading ends of the arms 62 and are engageable with the respective supporting shafts 29 on one widthwise sides of the frame 21. A cam groove 66 opens at a peripheral edge of the leading end portion of the each arm 62 and extends in a specified direction. Furthermore, a resilient locking piece 67 is formed at the leading end portion of each arm 62. The resilient locking piece 67 is cantilevered along the outer peripheral edge of the arm 62 and is resiliently deformable toward a deformation space 68 at an inner side of the resilient locking piece 67. A bottomed recessed groove 69 is formed in the inner surface of each arm portion 62 and communicates with the deformation space 68. Further, the recessed groove 69 is arranged substantially along an arc centered on the bearing hole 65.

A projection 70 projects forward at the front end of a substantially longitudinal central part of each arm 62. Further, a receiving groove 71 is formed in a substantially longitudinal central part of the inner surface of each arm 62. The receiving groove 71 extends from the projection 70 to the front end of the arm 62 substantially continuous with the base end of the projection 70 and is open at the other widthwise end of the projection 70 and the front end of the arm 62. A pressing portion 62 is defined at the back end of the receiving groove 71 and can press the housing 20 toward the mating housing 80 in a connecting process, as described later. The pressing portion 72 is substantially parallel to the front end of the arm 62 and extends substantially horizontally along the width direction at a connection position CP to be described later. Further, one widthwise edge of the receiving groove 71 is arranged substantially along an arc centered on the bearing hole 65.

The lever 60 is rotatable between a connection start position CSP and the connection position CP about the supporting shafts 29 with the supporting shafts 29 fit in the bearing holes 65. The retaining pieces 30 are arranged to contact the outer opening edges of the bearing holes 65 when the supporting shafts 29 are fit into the bearing holes 65 to prevent detachment of the lever 60 from the housing 20. The coupling 61 projects back the frame 21 and the lever 60 is in an oblique posture with respect to the connecting direction CD and the forward and backward directions FBD at the connection start position CSP. However, the coupling 61 is near the frame 21 and the lever 60 is in a substantially horizontal posture along the width direction (i.e. substantially orthogonal to the connecting direction CD and the forward and backward directions FBD) at the connection position CP. Further, the leading ends of the resilient locking pieces 67 are engaged with the bulges 32 at the connection start position CSP so that the lever 60 is prevented from displacing toward the connection position CP. Additionally, the projections 31A on the one widthwise side enter the recessed grooves 69 and contact first stoppers 73 at one ends of the recessed grooves 69 at the connection start position CSP so that the lever 60 cannot rotate in a direction opposite to the rotating direction toward the connection position CP. Furthermore, at the connection start position CSP, the leading end portions of the projections 70 are arranged to come contact the outer surfaces of the frame 21 so that the arms 62 cannot inclined inward and so that the wires (not shown) drawn out through the rear end of the frame 21 cannot be caught.

A pressing force applied to the lever 60 to move the lever 60 from the connection start position CSP toward the connection position CP causes the resilient locking pieces 67 to deform resiliently and disengage from the bulges 32. The projection 31A on the one widthwise sides are displaced in the recessed grooves 69 as the lever 60 is displaced toward the connection position CP. When the lever 60 reaches the connection position CP, the projection 31A contacts respective second stopper 74 at the end of the recessed groove 69 and the lock 63 resiliently engages the engaging portion 83 of the mating housing 80 to hold the lever 60 at the connection position CP. At this time, the projections 31B on the other widthwise sides enters the respective receiving grooves 71 along one widthwise edges.

The lever 60 initially is held at the connection start position CSP and the housing 20 is fit lightly to the mating housing 80 along the connecting direction CD so that the cam followers 82 enters the cam groove 66. Subsequently, the grip 64 is pushed or pulled to rotate the lever 60 toward the connection position CP. Thus, the cam followers 82 slide along the groove surfaces of the cam grooves 66 to produce a cam action between the 60 and the mating housing 80 and the mating housing 80 that enables the housing 20 to connected with a small connecting force. The two housings 20, 80 are connected properly and the terminal fittings mounted in the housings 20, 80 are connected electrically conductively at proper depths when the lever 60 reaches the connection position CP. At this time, the projections 31B on the other widthwise side are inserted in the receiving grooves 71 and are substantially hidden from the outside by the respective arms 62.

The supporting shafts 29 for the lever 60 and the cam grooves 66 are displaced toward one side from the widthwise center. Thus, the housing 20 tends to be connected to the mating housing 80 faster at the one widthwise side and slower at the other widthwise side. As a result, in a final stage of the connecting process, the housing 20 may be in an oblique posture with respect to the mating housing 80 with the other widthwise side lifted as shown in FIG. 2. However, if the housing 20 comes to be in the oblique posture in the final stage of the connecting process, the projections 31B on the other widthwise side contact the respective pressing portions 72 and are pressed by the pressing portions 72 as the lever 60 is rotated further so that the lifted state of the housing 20 at the other widthwise side is gradually corrected. That is, the projections 31B on the other widthwise side are pressed or urged by the pressing portions 72 so that the oblique posture of the housing 20 is corrected in the connecting process and the housing 20 is connected to the mating housing 80 in a proper connection posture when the connecting operation is completed.

As described above, the first stoppers 73 of the lever 60 engaged with the projections 31A on the one widthwise side of the housing 20 to prevent the lever 60 from rotating in a direction opposite to the direction toward the connection position CP. If the housing 20 is inclined from the proper connection posture with respect to the mating 80 in the process of moving the lever 60 to the connection position CP, the pressing 72 of the lever 60 press the projections 31B on the other widthwise side of the housing 20 correct the connection posture of the housing 20. In this case, the respective projections 31A, 31B are formed before or adjacent to the supporting shafts 29. Thus, the formation positions of the pressing portions 72 need not be located at rear positions in the lever 60. Therefore, it is not necessary to form large cutout areas in the lever 60 and strength of the lever 60 can be ensured.

Further, the bottomed receiving grooves 71 are formed in the inner surfaces of the arms 62 of the lever 60 and the projections 31B on the other widthwise side are inserted in the receiving grooves 71 at the connection position. Thus, the projections 31B are protected from external matter.

Figure 7:
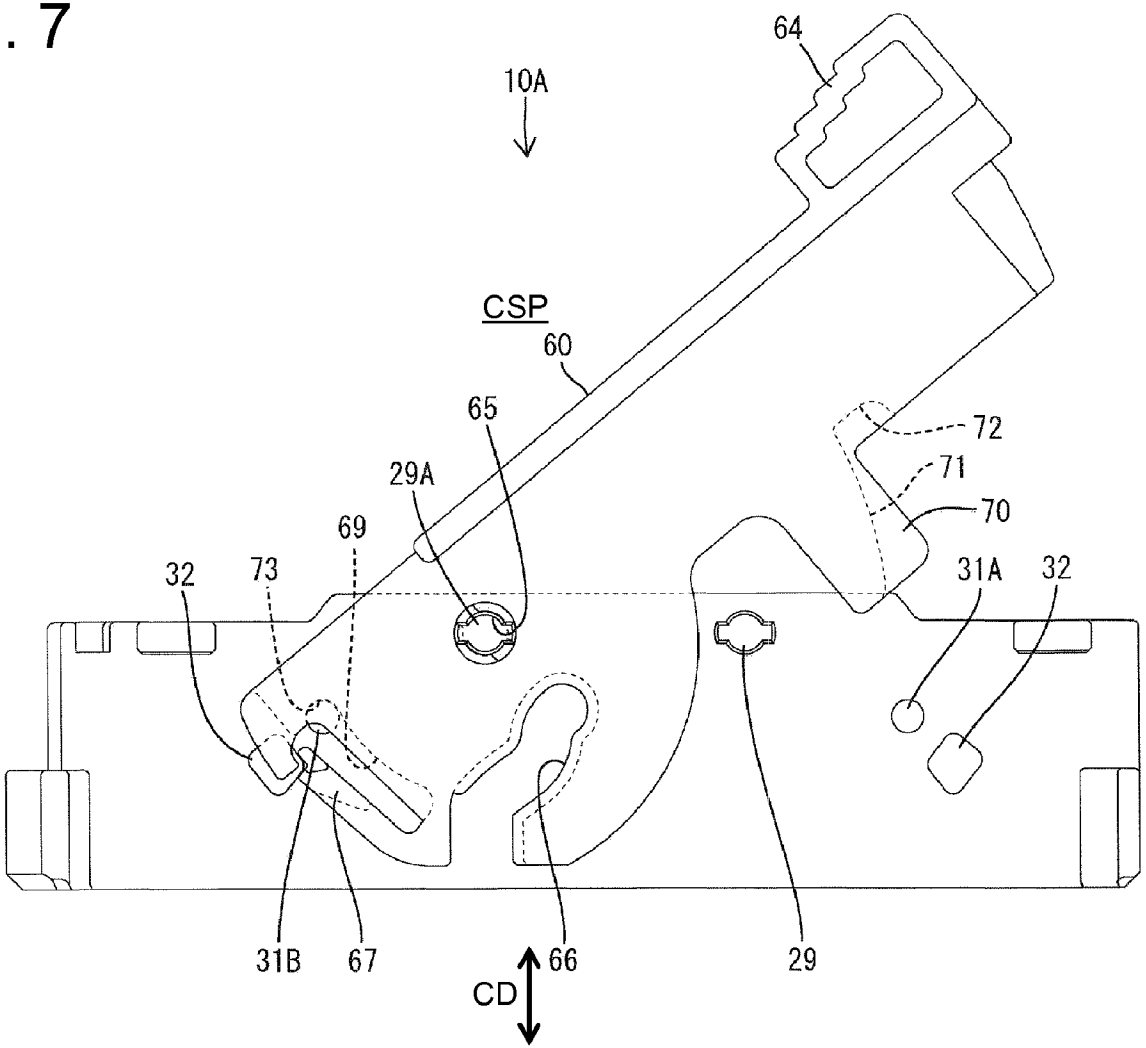
FIG. 7 is a plan view showing a state where a lever is held at a connection start position in a lever-type connector according to a second embodiment of the invention.
Figure 8:
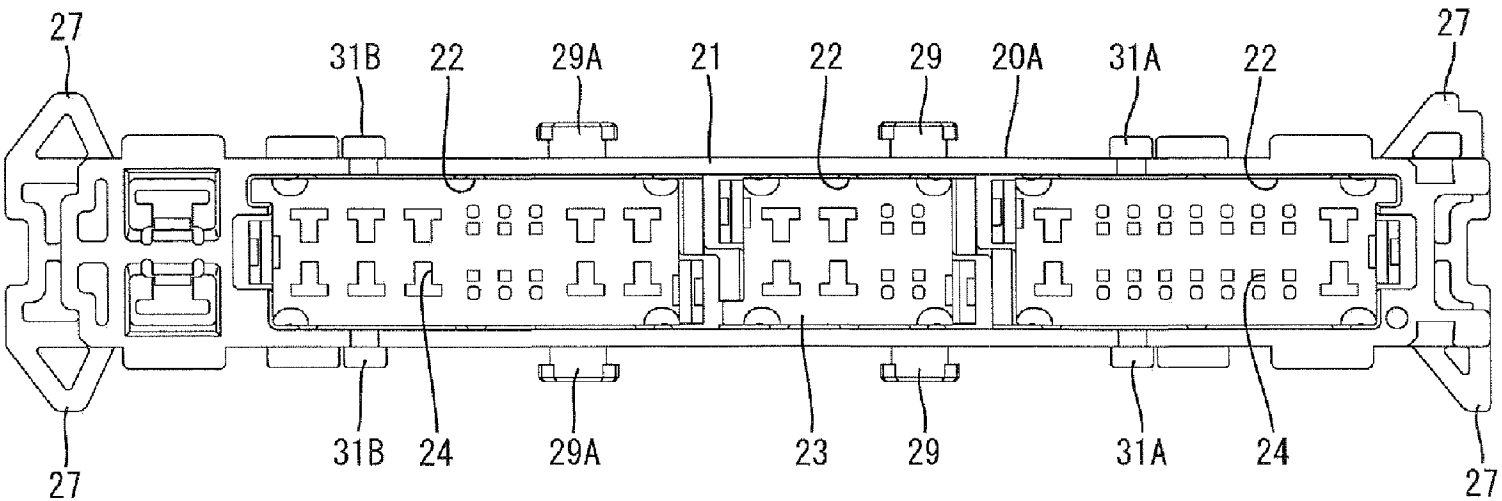
FIG. 8 is a rear view of a housing.

FIGS. 7 and 8 show a lever-type connector 10A according to a second embodiment of the invention. In the second embodiment, supporting shafts 29, 29A are paired in a width direction on a housing 20A. The other construction is similar to or substantially the same as the first embodiment. These similar or identical parts are identified by the same reference numerals as in the first embodiment and are not described again.

Two supporting shafts 29, 29A project at the opposite widthwise sides of a projecting part 28 on each of the upper and lower walls of the rear end edge of a frame 21. The supporting shafts 29, 29A are arranged substantially symmetrically with respect to the widthwise center of the frame 21.

According to the second embodiment, the orientation of a lever 60 can be reversed in the width direction from the state of the first embodiment as shown in FIG. 7 and, in this state, the supporting shafts 29A on the other widthwise side can be fit into bearing holes 65 of the lever 60. Thus, the lever 60 can be rotated about the supporting shafts 29A on the other widthwise side in a direction substantially opposite to the rotating direction in the first embodiment. At a connection start position CSP, projections 31B on the other widthwise side contact first stoppers 73 to prevent the lever 60 from rotating in a direction opposite to moving direction toward a connection position. On the other hand, if the housing 20A is inclined to lift one widthwise side with respect to the mating housing 80 in the process of connecting the two housings 20A, 80, pressing portions 72 press projections 31A on the widthwise side to eliminate a lifted state and correct a connection posture of the housing 20A.

According to the second embodiment, the first stoppers 73 of the lever 60 reversed in the width direction are engaged with the projections 31B on the other widthwise side to prevent a movement of the lever 60 at the connection start position. Thus, the projections 31B on the other widthwise side have both a function of correcting the inclination of the housing 20A and a function of preventing a movement of the lever 60 to the connection position. Therefore the construction of the housing 20A is simplified.

The invention is not limited to the above described and illustrated embodiments. For example, the following embodiments also are included in the scope of the invention.

The projections may prevent the rotation of the lever to the connection position instead of the bulging pieces.

The supporting shafts may be formed in the widthwise central part of the frame.

The receiving grooves may not be formed and the front ends of the arms may be formed as pressing portions for pressing the projections.

The lever may be displaceable along a different path than a circular one, such as a linear path, an elliptic path, a bent path or the like.

What is claimed is:

1. A lever-type connector, comprising:

a housing connectable to a mating housing along a connecting direction, the housing being formed with two projections at opposite sides in a width direction perpendicular to a connecting direction and a supporting shaft located between the projections and behind the projections in the connecting direction; and a lever displaceably supported on the supporting shafts of the housing and being displaceable between a connection start position and a connection position for causing the housing and the mating housing to reach a properly connected state, the lever being formed with at least one pressing portion for correcting a connection posture of the housing by pressing one of the projections in the connecting direction when the housing is inclined from a proper connection posture with respect to the mating housing in a process reaching the connection position.

2. The lever-type connector of claim 1, wherein the lever is mounted to the housing for rotation between the connection start position and the connection position for causing the housings to reach the properly connected state.

3. The lever-type connector of claim 2, wherein the lever is formed with at least one stopper engaged with the projection on one widthwise side at the connection start position for preventing a displacement of the lever.

4. The lever-type connector of claim 3, wherein a bottomed receiving groove is formed in an inner surface of the lever and opens at a front end of the lever in the connecting direction.

5. The lever-type connector of claim 4, wherein the pressing portion is formed at the back end of the receiving groove; and the projection is at least partly inserted in the receiving groove at the connection position.

6. The lever-type connector of claim 3, wherein the stopper of the lever reversed in the width direction is engageable with the projection on an opposite widthwise side to prevent movement of the lever at the connection start position.

7. The lever-type connector of claim 2, wherein the pressing portion is substantially parallel to a front end of the lever at the connection position.

8. The lever-type connector of claim 1, wherein the lever comprises at least one resilient lock and the housing comprises at least one bulge that interacts with the resilient lock to lock the lever at the connecting start position, wherein, a pressing force applied to the lever for urging the lever from the connection start position toward the connection position deforms the resilient lock and disengages the resilient lock from the bulge.

9. The lever-type connector of claim 8, wherein the bulge is arranged more outward in the width direction and more forward than the respective projection.

10. The lever-type connector of claim 9, wherein the projections and the bulges are arranged substantially symmetrically at opposite sides of a widthwise center.

11. The lever-type connector of claim 2, wherein two supporting shafts project from the housing and are arranged substantially symmetrically with respect to a widthwise center of the housing.

* * * * *